US009731503B2

(12) United States Patent
Kodoi et al.

(10) Patent No.: US 9,731,503 B2
(45) Date of Patent: Aug. 15, 2017

(54) LIQUID DISCHARGE HEAD AND LIQUID DISCHARGE APPARATUS USING THE SAME

(71) Applicant: CANON KABUSHIKI KAISHA, Tokyo (JP)

(72) Inventors: Takuma Kodoi, Kawasaki (JP); Keiji Tomizawa, Yokohama (JP); Chiaki Muraoka, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 13/867,631

(22) Filed: Apr. 22, 2013

(65) Prior Publication Data

US 2013/0286096 A1 Oct. 31, 2013

(30) Foreign Application Priority Data

Apr. 27, 2012 (JP) ..... 2012-103739
Sep. 19, 2012 (JP) ..... 2012-205665

(51) Int. Cl.
*B41J 2/165* (2006.01)
*B41J 2/14* (2006.01)
*B41J 2/16* (2006.01)

(52) U.S. Cl.
CPC ..... *B41J 2/14* (2013.01); *B41J 2/1404* (2013.01); *B41J 2/14129* (2013.01); *B41J 2/1603* (2013.01); *B41J 2/1628* (2013.01)

(58) Field of Classification Search
None
See application file for complete search history.

(56) References Cited

U.S. PATENT DOCUMENTS 5,963,234 A * 10/1999 Miyazawa ..... B41J 2/14233 347/43
6,390,606 B1 5/2002 Terui et al.
(Continued)

FOREIGN PATENT DOCUMENTS

JP 11-348290 A 12/1999
JP 2002-248771 A 9/2002
(Continued)

OTHER PUBLICATIONS

Japanese Office Action dated Jun. 28, 2016, in Japanese Patent Application No. 2012-205665.

*Primary Examiner* — Alejandro Valencia
(74) *Attorney, Agent, or Firm* — Fitzpatrick, Cella, Harper & Scinto

(57) ABSTRACT

A liquid discharge head includes a substrate having an element that discharges liquid by generating thermal energy to generate an air bubble in the liquid, and a liquid supply port for supplying the liquid to the element, and a flow path forming assembly including a flow path forming member having a discharge port for discharging the liquid and, between the substrate and the flow path forming member, a pressure chamber including the element disposed adjacent thereto and a flow path causing the pressure chamber and the liquid supply port to communicate with each other. In addition, an interlayer is provided on a joining portion of the substrate and the flow path forming member and provided so as to protrude from between the substrate and the flow path forming member into the flow path, and a protection layer including metal is formed so as to cover the element. The interlayer is not disposed on a boundary portion between the pressure chamber and the flow path, and the protection layer is disposed at least on the boundary portion.

8 Claims, 7 Drawing Sheets

(56) References Cited

U.S. PATENT DOCUMENTS

| | | | | |
|---|---|---|---|---|
| 6,676,241 | B2 | 1/2004 | Yabe | |
| 7,150,518 | B2 * | 12/2006 | Watanabe | 347/71 |
| 7,654,648 | B2 | 2/2010 | Tomizawa et al. | |
| 7,891,784 | B2 * | 2/2011 | Ozaki et al. | 347/71 |
| 7,984,976 | B2 | 7/2011 | Tomizawa et al. | |
| 8,128,204 | B2 | 3/2012 | Ozaki et al. | |
| 2009/0058952 | A1 * | 3/2009 | Park | B41J 2/1404 347/64 |
| 2010/0149284 | A1 * | 6/2010 | Yazaki | 347/71 |

FOREIGN PATENT DOCUMENTS

| | | | |
|---|---|---|---|
| JP | 2007-230132 | A | 9/2007 |
| JP | 2008-179039 | A | 8/2008 |

* cited by examiner

LIQUID DISCHARGE HEAD AND LIQUID DISCHARGE APPARATUS USING THE SAME

BACKGROUND OF THE INVENTION

Field of the Invention

The present invention relates to a liquid discharge head used for a liquid discharge apparatus, such as an inkjet printing apparatus, that discharges a liquid, such as ink, to perform image formation and printing.

Description of the Related Art

Conventionally, as an element that generates energy for discharging a liquid such as ink, there has been known a liquid discharge head provided with an electrothermal conversion element such as a heater, a piezoelectric element formed using a piezoelectric material, or the like.

In FIG. 7, shown is a partial cross-sectional view of a typical liquid discharge head that uses an electrothermal conversion element as an energy generating element. This liquid discharge head has an Si (silicon) substrate 11 in which a liquid supply port 16 is formed and on which an energy generating element 3 is provided, and a flow path forming member 15 provided on the Si substrate 11. Between the flow path forming member 15 and the Si substrate 11, there are formed a plurality of pressure chambers 14 including the energy generating element 3 and being aligned substantially at regular intervals, and a flow path 17 that causes the respective pressure chamber 14 and the liquid supply port 16 to communicate with each other. In the flow path forming member 15, a discharge port 9 that causes the respective pressure chamber 14 and an outer space to communicate with each other is formed at a position facing the energy generating element 3 of the respective pressure chamber 14. The energy generating element 3 is driven by, for example, an electric circuit or the like that is provided at the liquid discharge head, using a semiconductor manufacturing technology.

In the liquid discharge head with such a configuration, in the case where ink is supplied from the liquid supply port 16 to the flow path 17, it is sent to the pressure chamber 14 through the flow path 17. Subsequently, ink close to the energy generating element 3 bubbles by being instantaneously heated and boiled due to drive of the energy generating element 3, and ink close to the discharge port 9 is discharged from the discharge port 9 by a bubble pressure.

Incidentally, a flow path forming member may peel off from an Si substrate because of stress applied due to flowing of ink through a flow path and a pressure chamber, swelling of the flow path forming member due to soaking of a solvent component of the ink, and the like. In the case where the flow path forming member peels off from the Si substrate, a portion of the flow path forming member having peeled off from the Si substrate prevents an ink flow, a discharge property of the ink changes, and an undesirable effect on image formation may be caused.

There has been known a configuration in which, in order to suppress peeling-off of the flow path forming member from the Si substrate, an interlayer formed of thermoplastic resin which has adhesiveness to the Si substrate higher than the flow path forming member and which can hold the flow path forming member is interposed between the Si substrate and the flow path forming member. For example, FIG. 5A in Japanese Patent Laid-Open No. 2007-230132 discloses a configuration as a nozzle 7B in which an interlayer is laid at a position other than a portion corresponding to a pressure chamber on an Si substrate, that is, so as to surround an energy generating element while avoiding an upper surface of the energy generating element.

SUMMARY OF THE INVENTION

However, in the configurations as described above in which the interlayer surrounds the energy generating element while avoiding the upper surface thereof, a step on the Si substrate due to a film thickness of the interlayer exists near the energy generating element. Therefore, there is a case where a bubble generated by drive of the energy generating element is affected by the step in growing to thereby be deformed, and where a bubble remains in the pressure chamber. The remaining bubble may affect formation of a bubble generated by next drive of the energy generating element, and an undesirable effect on formation of an ink droplet to be discharged may occur. The remaining bubble vanishes away with the lapse of time, but along with the progress of high-speed recording, in recent years, next discharge has been started before the remaining bubble disappears in the case where printing is performed with a high discharge frequency, and thus the remaining bubble has a significant effect on printing.

In contrast, a nozzle 7A of FIG. 5A in Japanese Patent Laid-Open No. 2007-230132 has a configuration in which the interlayer is not interposed also in a long flow path portion in addition to the pressure chamber. That is, it has the configuration in which the interlayer is laid only in a ground region of the flow path forming member on the Si substrate, and a region other than the ground region of the flow path forming member on the Si substrate serves as a portion where the Si substrate is exposed to be able to come into contact with ink. A part of Si-based members constituting the Si substrate and a liquid discharge head is dissolved by ink depending on a pH of the ink or a type of a used solvent, and corrosion proceeds from the portion, resulting in a possibility of deteriorating a life of the liquid discharge head. In Japanese Patent Laid-Open No. 2007-230132, such an effect of corrosion due to the ink has not been considered, and the configuration has been disclosed in which the interlayer is directly provided on the Si substrate.

Accordingly, there has been required a liquid discharge head with a long life in which a flow path forming member does not easily peel off from a substrate, poor ink discharge does not easily occur, and dissolution due to ink rarely occur.

A liquid discharge head of the present invention for solving the above-described problems comprises: a substrate in which an element that generates energy utilized in order to discharge liquid, and a liquid supply port for supplying the liquid to the element are provided;

a flow path forming member which is provided on the substrate, forms a space between the substrate and the flow path forming member and has a discharge port for discharging the liquid formed therein, the space constituting a pressure chamber including the element and a flow path causing the pressure chamber and the liquid supply port to communicate with each other; an interlayer which is provided between the substrate and the flow path forming member; and a protection layer including metal which is formed so as to cover the element in order to protect the element, wherein the interlayer is disposed so as to avoid a first region corresponding to the element, a second region corresponding to a region of the flow path on a side of the pressure chamber, and a portion corresponding to a boundary between the first region and the second region, and wherein at least a part of the portion is covered with the protection layer.

In the liquid discharge head of the present invention, the interlayer is laid in a ground region of the flow path forming member on an Si substrate, and thus peeling-off of the flow path forming member from the Si substrate can be prevented. In addition, since a step due to a film thickness of the interlayer is not formed near a portion where a bubble generated by drive of an energy generating element grows, the liquid discharge head of the present invention has a structure in which a residual bubble is unlikely to stay, and thus poor ink discharge is improved. Furthermore, since a region with which ink can come into contact is covered with the interlayer and/or the protection layer which are/is excellent in solvent resistance, a member constituted by an Si-based material is prevented from being dissolved due to the ink, and a long life of the liquid discharge head is achieved.

Further features of the present invention will become apparent from the following description of exemplary embodiments (with reference to the attached drawings).

DESCRIPTION OF THE EMBODIMENTS

Hereinafter, the present invention will be described with reference to the drawings.

A liquid discharge head according to an embodiment of the present invention will be described using FIGS. 1A, 1B, 1C and 6.

Figure 6:
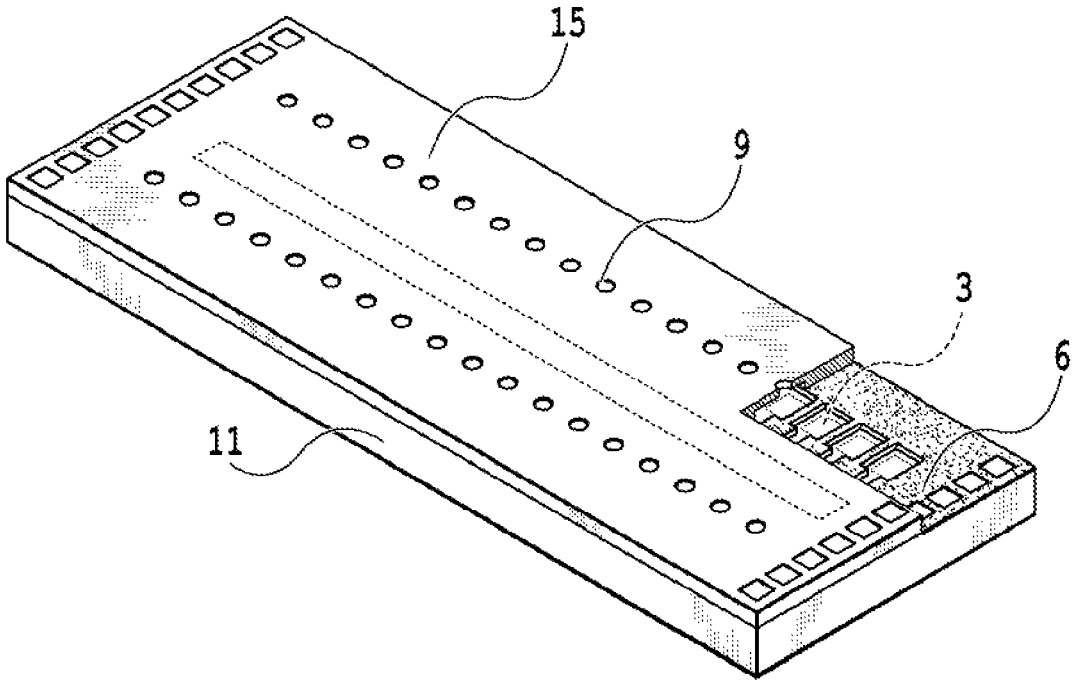
FIG. 6 is a schematic perspective view of a printing element substrate used for the liquid discharge head of the embodiment of the present invention.
Figure 7:
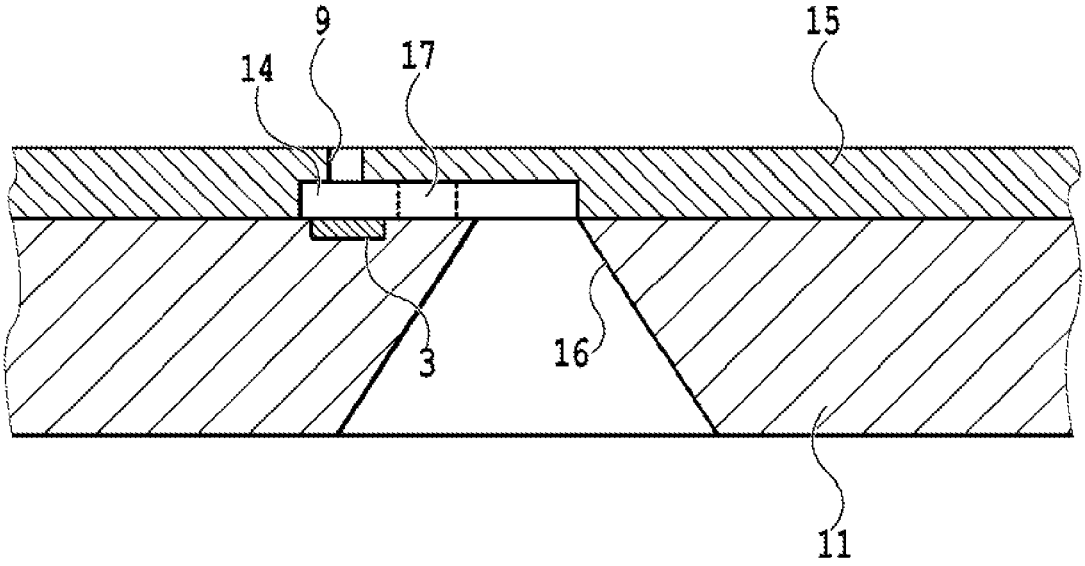
FIG. 7 is a schematic partial cross-sectional view showing a configuration of a typical liquid discharge head.

FIG. 6 is a perspective view of a printing element substrate used for the liquid discharge head according to the embodiment of the present invention, in the case of being viewed from a face side where discharge ports are aligned, in which a part of a flow path forming member is made transparent. As shown in FIG. 6, the liquid discharge head according to the embodiment of the present invention includes, in addition to a configuration similar to a typical liquid discharge head illustrated in FIG. 7, an interlayer 6 disposed at a joining portion of the Si substrate 11 and the flow path forming member 15. The interlayer 6 is the layer formed of thermoplastic resin which has adhesiveness to the Si substrate 11 higher than the flow path forming member 15 and is capable of holding the flow path forming member 15, in order to suppress peeling-off of the flow path forming member 15 from the Si substrate 11. As thermoplastic resin, for example, polyether amide resin can be used. The interlayer 6 is arranged avoiding an upper surface of the energy generating element 3 so as not to peel off from the Si substrate 11 by being damaged due to heat generated by the energy generating element 3 that generates energy utilized in order to discharge liquid. More detailed arrangement of the interlayer 6 will be mentioned later with reference to FIGS. 1A to 1C. The Si substrate 11 and the flow path forming member 15 are joined via the interlayer 6 so that the energy generating element 3 and the discharge port 9 have a positional relation of facing each other.

A configuration near an energy generating element of a liquid discharge head will be described using FIGS. 1A to 1C.

Figure 1A:
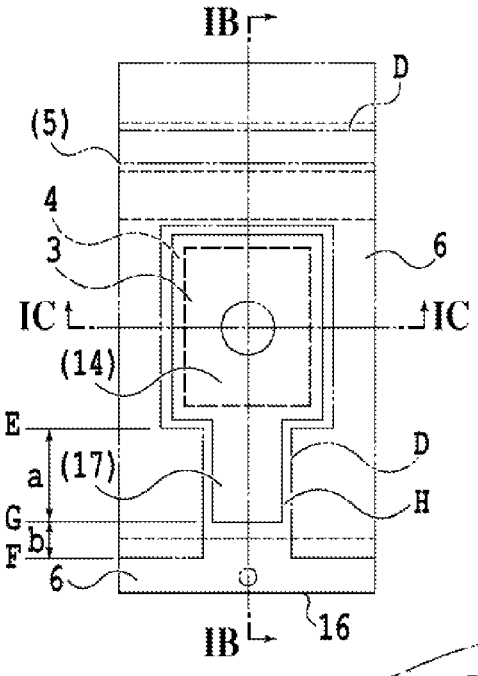
FIG. 1A is a schematic elevational view showing a layer configuration near an energy generating element of a liquid discharge head according to an embodiment of the present invention.

FIG. 1A is a schematic elevational view of the liquid discharge head according to the embodiment of the present invention, in the case of being viewed from the face side in a state where a flow path forming member is virtually removed. FIG. 1B is a schematic partial cross-sectional perspective view of the liquid discharge head taken along a line IB-IB in FIG. 1A. FIG. 1C is a schematic partial cross-sectional view of the liquid discharge head taken along a line IC-IC in FIG. 1A. In FIG. 1A, in order to make a layer configuration understandable, the interlayer 6 is depicted to be transparent.

Figure 1B:
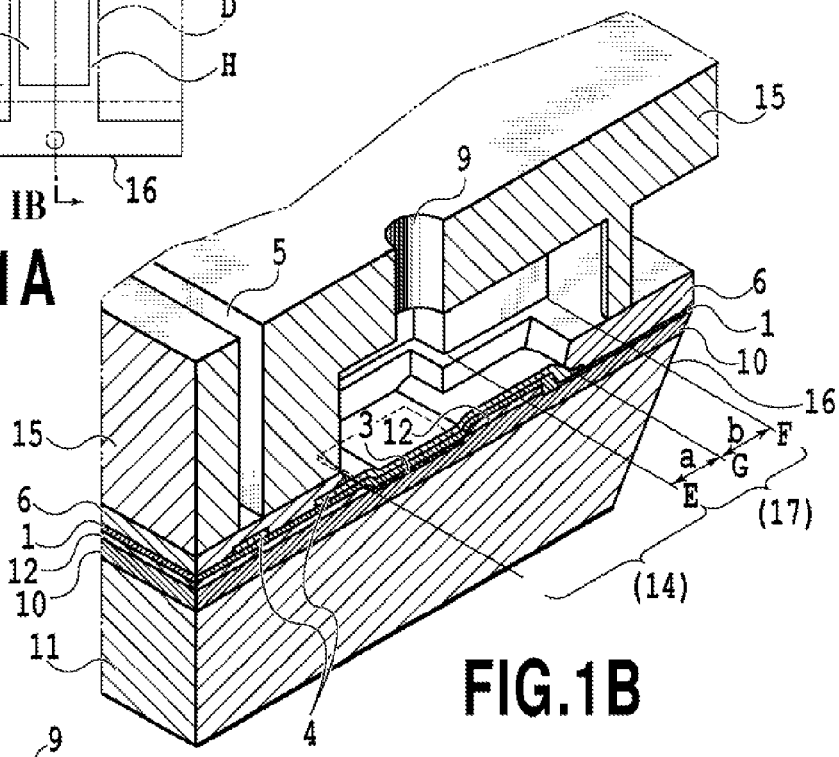
FIG. 1B is a schematic partial cross-sectional perspective view of the layer configuration taken along a line IB-IB of FIG. 1A.
Figure 1C:
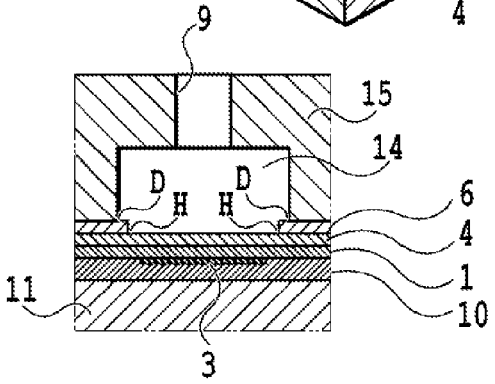
FIG. 1C is a schematic partial cross-sectional view of the layer configuration taken along a line IC-IC of FIG. 1A.

The liquid discharge head according to the embodiment of the present invention shown in FIGS. 1B and 1C is provided with the Si substrate 11 as a substrate. On an upper surface of the Si substrate 11, heat storage layer 10 is formed constituted by $SiO_2$ (silicon dioxide) for suppressing dissipation of heat generated in the case where the energy generating element 3 is heated.

On the heat storage layer 10, there is formed the filmy energy generating element 3 constituted by TaSiN (tantalum silicon nitride) that generates heat by energization, and an Al (aluminum) wiring 12 for supplying electric power is formed in a predetermined pattern so as to be in contact with the energy generating element 3. By a configuration constituted by the Al wiring 12 and the energy generating element 3, energy that discharges ink from the discharge port 9 can be generated. In the example, a wiring pattern is provided with a predetermined gap therebetween, a current flows in a region of the energy generating element 3 corresponding to the predetermined gap, and thus the energy generating element 3 generates heat.

On the energy generating element 3 and the wiring 12, there is formed an insulation layer 1 formed of SiN (silicon nitride) or SiO (silicon oxide) that serves to insulate, from ink, the energy generating element 3 and the wiring 12.

On this insulation layer 1, there is formed a protection layer 4 which serves as a cavitation-resistant film protecting the energy generating element 3 from impact in the case where an air bubble generated in ink due to film boiling disappears and serves to prevent corrosion of component members due to ink. In the example, Ta (tantalum) that is a metal is used as a material for the protection layer 4, but any metal can be used regardless of the type thereof as long as the metal is a platinum group element such as Ir (iridium).

Arrangement of the protection layer 4 will be described in detail. The protection layer 4 is disposed so as to cover a whole region corresponding to the upper surface of the energy generating element 3 for the purpose of cavitation resistance. In addition, the protection layer 4 can be disposed in a region on the Si substrate 11 that may come into contact with ink when the liquid discharge head is made into a product, for the purpose of preventing corrosion due to the ink.

In the case where the protection layer 4 is laid over a region from the flow path 17 to the liquid supply port 16, dissolution of a Si-based material due to ink can be remedied. In contrast, the protection layer 4 is preferably disposed so that an end of the protection layer 4 on a liquid supply port side does not extend near an edge of the liquid supply port 16 from a viewpoint of peeling-off of the component member of the liquid discharge head. The above will be described using FIGS. 3 and 4.

Figure 3:
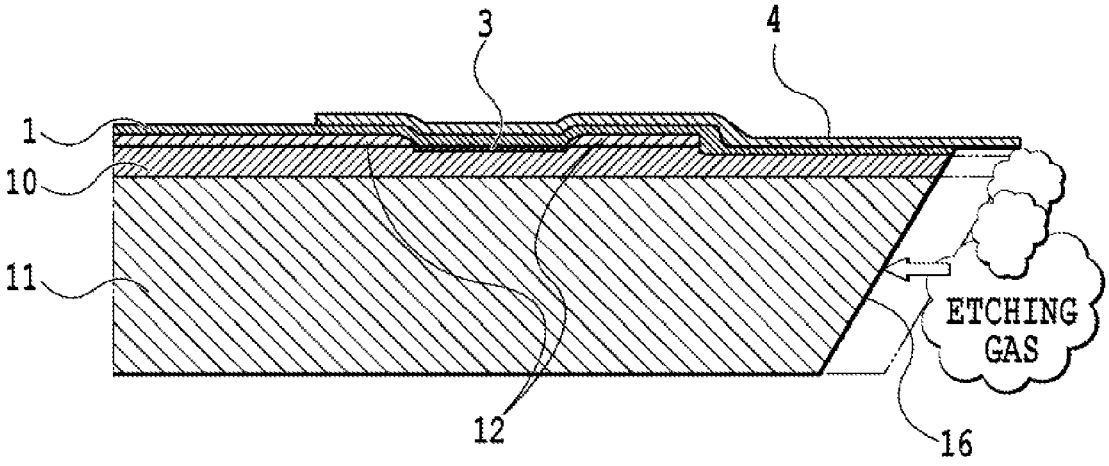
FIG. 3 is a view illustrating possible corrosion at the time of manufacturing in a liquid discharge head having a protection layer extended to a liquid supply port.

FIG. 3 shows an example in which the protection layer 4 is provided on the Si substrate so as to extend to the edge of the liquid supply port 16 at the time of manufacturing a liquid discharge head. As shown in FIG. 3, the liquid supply port 16 is formed by performing etching by gas on the Si substrate 11. According to a configuration in which the protection layer 4 is extended to the edge of the liquid supply port 16 on the Si substrate 11, the Si substrate 11 itself, and the component member constituted by the Si-based material that exists between the protection layer 4 and the Si substrate 11 are corroded due to etching gas. At this time, the protection layer 4 that is a metal film remains, and takes a form of projecting toward a liquid supply port 16 side. Then, cracks and peeling-off of the layer configuration occur with the projection being as a starting point, which may cause peeling-off of the flow path forming member 15.

Figure 4:
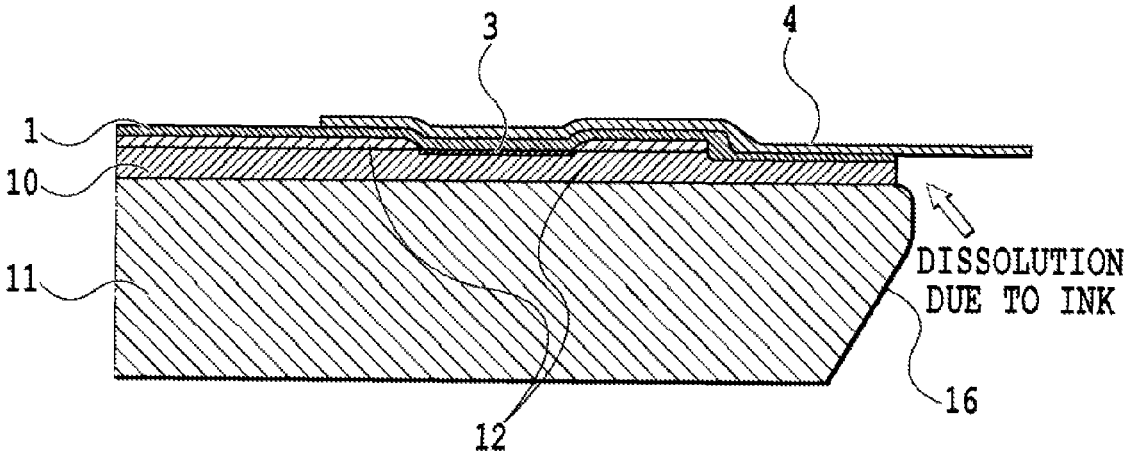
FIG. 4 is a view illustrating possible corrosion at the time of use in the liquid discharge head having the protection layer extended to the liquid supply port.

Furthermore, FIG. 4 shows an example where, at the time of using the liquid discharge head, the protection layer 4 exists on the Si substrate 11 so as to extend to the edge of the liquid supply port 16. Also in the case where ink corrodes the Si substrate in the use of the ink having a property of dissolving the Si-based materials due to the pH, used solvent or the like, a similar phenomenon arises and peeling-off of the flow path forming member 15 may occur.

Accordingly, in consideration of a state of the liquid discharge head at the time of the manufacturing and the use, the protection layer 4 is preferably disposed so that the end thereof does not cover the vicinity of the liquid supply port 16, and thus peeling-off of the flow path forming member 15 can be suppressed.

In the example, referring to FIG. 1A, the protection layer 4 of Ta or the like, is formed so as to cover a whole area of a region on the Si substrate 11 corresponding to a bottom surface of the pressure chamber 14, and so as to extend in a region on the Si substrate 11 corresponding to a bottom surface of the flow path 17 that causes the pressure chamber 14 and the liquid supply port 16 to communicate with each other. The end of the protection layer 4 on the liquid supply port 16 side is positioned near an end of the flow path 17 on the liquid supply port 16 side (in FIG. 1A, the position of the end of the flow path 17 in a longitudinal direction is indicated with a line F).

In addition, although not shown in FIG. 6, as shown in FIGS. 1A and 1B, in the liquid discharge head according to the embodiment of the present invention, a trench 5 that is a groove-like through-hole, is formed in the flow path forming member 15. In the case where there is located a plurality of discharge port rows where a plurality of discharge ports 9 is aligned on the face of the liquid discharge head, the trench 5 plays a role of preventing ink of the next discharge port row from coming near the discharge port 9 and causing color mixture at the time of using the liquid discharge head. In addition, also at the time of manufacturing the liquid discharge head, the trench 5 plays a role of preventing peeling-off of the component member due to deformation by relieving a force applied from outside, such as stress due to heat at the time of cutting or welding of the printing element substrate.

Since the trench 5 is the through-hole formed in the flow path forming member 15 as mentioned above, a region on the Si substrate 11, corresponding to a position of the trench 5 is not covered with the flow path forming member 15, is communicated with an outer space, and thus may come into contact with ink. Therefore, the protection layer 4 is disposed also in the region on the Si substrate 11 corresponding to the trench 5 portion in order to prevent corrosion due to ink.

Next, arrangement of the interlayer 6 will be described with reference to FIGS. 1A to 1C. In FIGS. 1A to 1C, a line D indicates an outline of a ground surface of the flow path forming member 15 in the flow path forming member 15 being joined on the Si substrate 11. In addition, a line H indicates an outline of a disposing region of the interlayer 6 in the case where the interlayer 6 is disposed on the Si substrate 11.

The interlayer 6 is disposed on the Si substrate 11 so as to exist by necessity on the ground surface of the flow path forming member 15 where the flow path forming member 15 is to be joined on the Si substrate 11. In contrast, the interlayer 6 is, as mentioned above, disposed on the Si substrate 11 so as to avoid a portion corresponding to the upper surface of the energy generating element 3 and a region corresponding to a part of the flow path. Accordingly, an inside surrounded by the line H is a non-disposing region of the interlayer 6.

Here, in an ink discharge process of inkjet printing using the liquid discharge head, an air bubble for discharging an ink droplet is generated in the pressure chamber 14 of the liquid discharge head, and may extend in the flow path 17 in growing. Since the interlayer 6 has a film thickness of approximately several μm, a step due to the film thickness of the interlayer 6 prevents generation and growth of the air bubble in the ink discharge process depending on a position where the interlayer 6 is disposed, and causes deformation of the bubble. When one discharge operation is finished, ink is passed through the flow path 17 from the liquid supply port 16, and is refilled in the pressure chamber 14. Until the pressure chamber 14 is filled by the refill of the ink, bubbles divided from the deformed bubble are generated and may remain near the step due to the interlayer 6. The remaining bubbles get out of the discharge port and disappear with the lapse of time. However, in the case where next discharge operation is performed in a state where bubbles remain, the remaining bubbles and a newly generated air bubble for discharging an ink droplet are merged and bubbling becomes unstable, and thus a constant ink droplet cannot be formed, causing poor discharge. Accordingly, in the case where an ink discharge operation is repeated with a high output frequency, poor bubbling due to the remaining bubbles occurs more frequently, which may cause problems in printing operation and a printed image.

Consequently, to ensure that a step is not formed near a portion where a bubble generated by drive of the energy generating element 3 grows, the interlayer 6 is positioned so that an end thereof is not arranged near a boundary between the pressure chamber 14 and the flow path 17. That is, the interlayer is not formed in a region (first region) corresponding to the energy generating element 3 inside the pressure chamber 14, in a region (second region) corresponding to a region of the flow path 17 on a pressure chamber side, and at a boundary portion between the first region and the second region. In FIGS. 1A and 1B, a line E indicates a position of a boundary between the pressure chamber 14 and the flow path 17 in the longitudinal direction of the flow path 17. In addition, in FIGS. 1A and 1B, a line G indicates a position of the end of the interlayer 6 near the flow path 17 in the longitudinal direction of the flow path 17. Here, unlike the configuration exemplified in FIG. 1A, a configuration in which the boundary between the flow path 17 and the pressure chamber 14 is not clear, that is, a configuration in which widths of the flow path 17 and the pressure chamber 14 are the same as each other and the flow path 17 does not have a narrow portion, also falls in the scope of the present invention. In a case of this configuration, a position indicated by the line E, that is, the boundary, is specified by a positional relation of the energy generating element 3 and the flow path 17. Specifically, a line is set as the line E that indicates a position spaced apart from an end of the energy generating element 3 on a side of a flow path 17 by a same distance as a distance from the end of the energy generating element 3 on a side opposite to the flow path 17 side to an end of the pressure chamber 14.

The end of the interlayer 6 near the flow path 17 is preferably formed at a position near the end of the flow path 17 on the liquid supply port 16 side, the position being spaced apart from the end on the liquid supply port 16 side by a predetermined distance.

In addition, the interlayer 6 is disposed so as to cover ends of the protection layer 4, and as a result, all the ends of the protection layer 4 are covered with the interlayer 6. The interlayer 6 and the protection layer 4 are formed as described above, and thus a Si-based component member in the liquid discharge head is kept so as not to be exposed as a surface that can come into contact with ink.

Here, as shown in FIGS. 1A and 1B, in a region on the Si substrate 11 that is covered with the protection layer 4 but that is not covered with the interlayer 6, a length of a region in the flow path 17 in the longitudinal direction of the flow path 17 is set as a. In addition, a length is set as b between the line G in a boundary region on the Si substrate 11 that is covered with the protection layer 4 but that is not covered with the interlayer 6, and a boundary line F at the end of the flow path 17 on the liquid supply port 16 side. In order to reduce an effect on growth of a bubble that discharges ink, a dimensional relation between a and b can be set to satisfy the following formula (1) for the purpose of exemplification, not for the purpose of limiting the present invention.

$$a>b \quad (1)$$

The interlayer 6 may be disposed near the trench 5 in order to keep adhesiveness of an interface between the flow path forming member 15 and the protection layer 4.

According to the above-described configuration of the embodiment of the present invention, at a position spaced apart, by a predetermined distance, from the end on the liquid supply port 16 side toward the pressure chamber 14 side, the position being near the end of the flow path 17 on the liquid supply port 16 side, and positions near the trench 5, there exist interfaces between the flow path forming member 15 and the interlayer 6. That is, since a space formed between the flow path forming member 15 and the Si substrate, the space corresponding to a nozzle for discharging ink, is sandwiched by configurations having resistance to stress, the embodiment has a configuration in which the flow path forming member 15 and the Si substrate do not peel off easily.

Furthermore, according to the configuration of the embodiment of the present invention, the portion that may directly come into contact with ink is covered with the protection layer 4 (Ta in the present example). In addition to that, the interlayer 6 is polyether amide-based resin, and is excellent in solvent resistance. Therefore, even in the case where ink with high solubility is used, damage, dissolution, corrosion, and the like of a layer constituted by the Si-based material due to ink can be prevented, and a long life of the liquid discharge head can be achieved.

(Effect of the Invention)

In the following first table, results of performance tests of the liquid discharge head according to the embodiment of the present invention and of comparative examples will be shown, and effects of the present invention will be described.

[Sample]

The following three embodiments were used as samples.

A. WORKING EXAMPLE: THE LIQUID DISCHARGE HEAD ACCORDING TO THE EMBODIMENT OF THE PRESENT INVENTION SHOWN IN FIGS. 1A TO 1C

The liquid discharge head of a form in which the interlayer 6 is not laid over the region (first region) corresponding to the energy generating element 3 inside the pressure chamber 14 on the Si substrate 11, the region (second region) corresponding to the region of the flow path 17 on the pressure chamber 14 side, and the boundary portion between the first region and the second region, and is laid in other regions.

Figure 5:
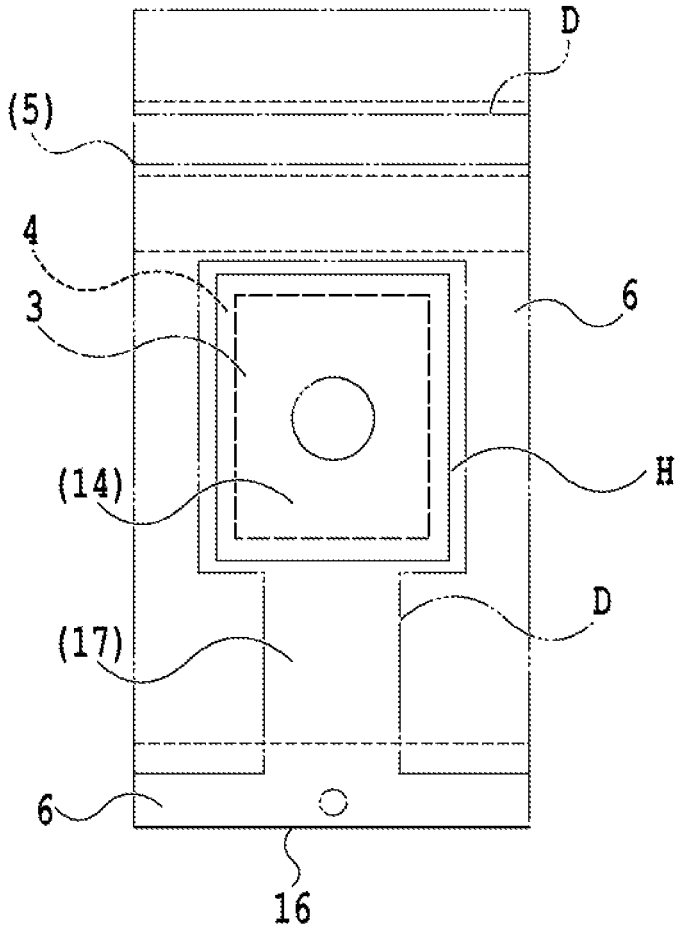
FIG. 5 is a schematic elevational view showing the liquid discharge head of the comparative example.

B. COMPARATIVE EXAMPLE 1: A LIQUID DISCHARGE HEAD WITH A CONFIGURATION SHOWN IN FIG. 5

The liquid discharge head having the configuration similar to the working example excluding the fact that a laying region of the interlayer 6 is set to be a portion on the Si substrate 11 other than the upper surface of the energy generating element 3.

C. COMPARATIVE EXAMPLE 2: A LIQUID DISCHARGE HEAD WITH A CONFIGURATION SHOWN IN FIG. 2

The liquid discharge head having the configuration similar to the working example excluding the fact that the laying region of the interlayer 6 is set to be only a contact portion of the Si substrate 11 and the flow path forming member 15 on the Si substrate 11.

[Test Item and Test Method]

Tests of the following three items were performed.

1. Discharge Performance at the Time of Printing with High Output Frequency

A liquid discharge head sample was mounted in a general inkjet printing apparatus, and printing operation by the inkjet printing apparatus was performed. At this time, an ink discharge frequency indicating a frequency of discharging ink from a discharge port was gradually increased from a frequency at the time of usual printing, and a state of bubble inside the discharge port was observed from a face of the liquid discharge head. In the present example, in the case where the discharge frequency was raised approximately from 15 kHz to 30 kHz, in a case where remaining bubbles of the bubbles generated by discharge operation disappeared by the time of next discharge operation, discharge performance was evaluated as good, and in a case where the remaining bubbles still existed, discharge performance was evaluated as poor.

2. Dissolution of Member Due to Ink

After being immersed in ink having a property of dissolving Si for a predetermined time under a high temperature, a printing element substrate portion of each liquid discharge head sample was taken out of the ink and cleaned, and it was observed whether or not corrosion due to ink was seen in a component member near a liquid supply port. In the case where corrosion was seen, such as retreat of an outline of the component member including a Si-based material, performance was evaluated as poor, and in the case where corrosion was not seen, performance was evaluated as good.

3. Peeling-Off of Member

An accelerated deterioration test corresponding to five-year test was performed in which each liquid discharge head sample and the printing element substrate portion thereof were immersed in ink, and placed under a high temperature condition over a predetermined time. In addition, a pressurization test was performed in which each liquid discharge head sample and the printing element substrate portion thereof were placed under a high pressure over a predetermined time. As to each test sample after these tests, a joining state between the component members was observed. In at least either the accelerated deterioration tests or the pressurization test, in the case where peeling-off has occurred between a flow path forming member and an interlayer, performance was evaluated as poor, and in the case where peeling-off did not occur and adhesiveness was kept, performance was evaluated as good.

[Test Result]

TABLE 1

First table. Performance test result of liquid discharge head

| test | Sample | | |
|---|---|---|---|
| | A. Working example | B. Comparative example 1 | B. Comparative example 2 |
| 1. Discharge performance | Good | Poor | Good |
| 2. Dissolution of member | Good | Good | Poor |
| 3. Peeling-off of member | Good | Good | Good |

A. WORKING EXAMPLE

In the working example, all of discharge performance, performance of dissolution of the member, and performance of peeling-off of the member were good.

B. COMPARATIVE EXAMPLE 1

In the comparative example 1, performance of dissolution of the member and performance of peeling-off of the member were good, but discharge performance was poor. In the case where there was observed a face of a liquid discharge head of the comparative example 1 after printing with a high discharge frequency was performed, a large amount of large ink droplets caused by ink discharge due to unintended poor bubbling were attached. In addition, when an image printed in a discharge performance test was observed, it was found that there exist a number of discharge ports in an undischarged state where ink was not discharged. That is, it is considered that since, in a configuration of the comparative example 1, the liquid discharge head has a large step of an interlayer near a region in which a bubble that discharges ink grows, remaining bubbles were taken in printing with a high output frequency, and thus poor discharge occurred.

C. COMPARATIVE EXAMPLE 2

Figure 2:
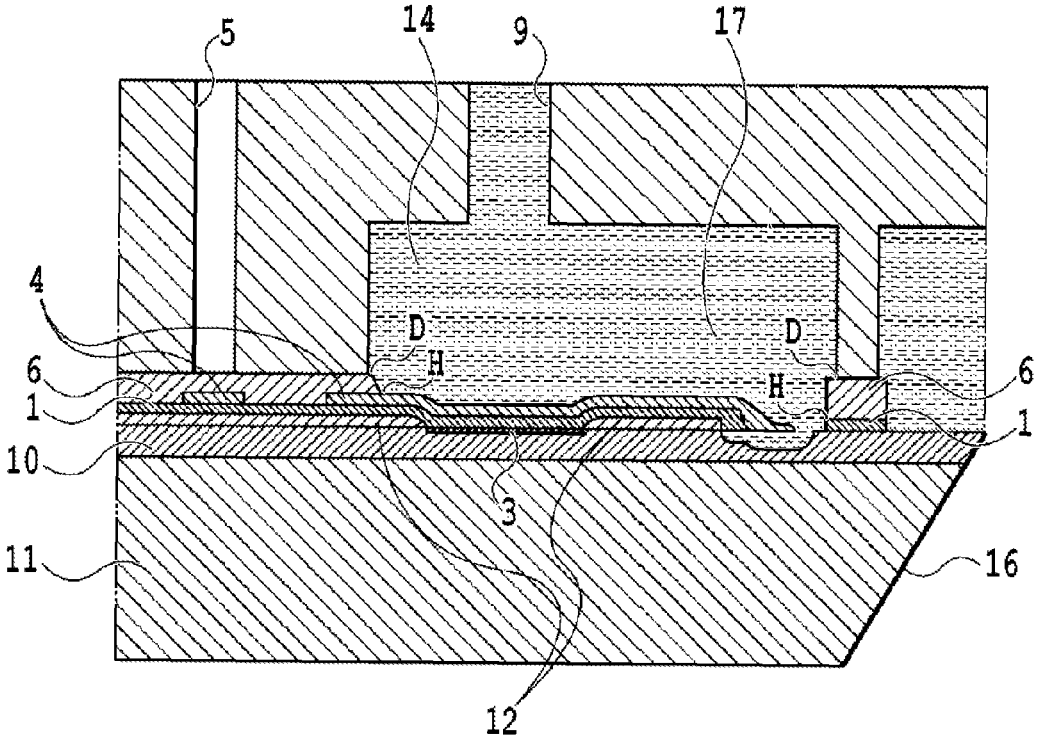
FIG. 2 is a schematic cross-sectional view showing a liquid discharge head of a comparative example.

In the comparative example 2, discharge performance and performance in peeling-off of the member were good, but performance of dissolution of the member was poor. That is, an amount of dissolution, in the ink, of a layer constituted by a Si-based material was large, and was a level that causes a problem. For details, according to a configuration of the comparative example 2, as shown in FIG. 2, SiN being a film of an insulation layer dissolves, and an aluminum electrode portion that must not touch the ink is also corroded. In the case where dissolution proceeds as described above, not only a discharge energy generating element of the liquid discharge head would not drive, but also there occurs a possibility of burnout of the inkjet printing apparatus itself mounted thereon.

D. CONCLUSION

As described above, in the comparative examples 1 and 2 that represent configurations of a conventional liquid discharge head, it was difficult to simultaneously overcome three problems, such as discharge performance, dissolution of the member, and peeling-off of the member. However, in the configuration according to the embodiment of the present invention, there is no problem in performance of the above-mentioned printing test and preservation tests, and these problems can be solved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2012-103739, filed Apr. 27, 2012 and 2012-205665, filed Sep. 19, 2012, which are hereby incorporated by reference herein in their entirety.

What is claimed is:

1. A liquid discharge head, comprising:

a substrate member including a silicon substrate layer, a discharge element that discharges liquid by generating thermal energy to generate an air bubble in the liquid, a liquid supply port for supplying the liquid to the discharge element, and a protection layer including metal which is formed so as to cover the discharge element;

a flow path forming member provided on a side of a surface of said substrate member on which the protection layer is provided and defining, between said substrate member and said flow path forming member, a pressure chamber comprising a heating portion of a surface of the protection layer that overlaps the discharge element in a perpendicular direction that is perpendicular to the surface of said substrate member and a flow path communicating between the pressure chamber and the liquid supply port and extending along the surface of said substrate member, said flow path forming member having a plurality of pressure chamber walls being perpendicular to the surface of said substrate member to form the pressure chamber and two flow path walls being perpendicular to the surface of said substrate member and opposed to each other to form the flow path; and an interlayer provided on a joining portion of said substrate member and said flow path forming member and including resin, wherein the plurality of pressure chamber walls are disposed in a rectangular shape so as to surround the heating portion except at a communication portion where the pressure chamber communicates with the flow path when viewed from the perpendicular direction, a distance between two pressure chamber walls of the plurality of pressure chamber walls on which the communication portion with the flow path is not provided and which are opposed to each other is greater than a distance between the two flow path walls, and said interlayer is provided on a portion of the flow path on a side of the liquid supply port and, an edge surface of said interlayer is located in a middle portion of the flow path with respect to a direction from the liquid supply port toward the pressure chamber such that the flow path has a portion, adjacent to the pressure chamber, where said interlayer is not provided and a step is formed by the edge surface of said interlayer in the flow path.

2. The liquid discharge head according to claim 1, wherein the protection layer includes tantalum.

3. The liquid discharge head according to claim 1, wherein said interlayer extends at least to an end of the flow path on the liquid supply port side.

4. The liquid discharge head according to claim 3, wherein the edge surface of said interlayer intersects a direction in which the flow path extends and constitutes a first boundary line, the first boundary line satisfying the following expression: $x>y$, in which x represents a length from a second boundary line that is a boundary between the pressure chamber and the flow path to the first boundary line and y represents a length from the first boundary line to an end of the flow path on the liquid supply port side.

5. The liquid discharge head according to claim 1, wherein said interlayer protrudes from between said substrate member and said flow path forming member into the pressure chamber and the flow path.

6. The liquid discharge head according to claim 5, wherein said interlayer is provided to surround the heating portion except at the communication portion when viewed from the perpendicular direction.

7. The liquid discharge head according to claim 3, wherein an end of the protection layer is positioned between i) the edge surface of said interlayer and ii) an end of the liquid supply port when viewed from the perpendicular direction.

8. The liquid discharge head according to claim 1, wherein the protection layer is exposed in the flow path from a portion bordering the pressure chamber up to the edge surface of the interlayer.

* * * * *